United States Patent [19]

Labate

[11] Patent Number: 4,840,356

[45] Date of Patent: Jun. 20, 1989

[54] EXTERNALLY REPLACEABLE STIRRING PLUG FOR MOLTEN METAL VESSELS

[76] Inventor: Michael D. Labate, 115 Hazen Ave., Ellwood City, Pa. 16117

[21] Appl. No.: 205,821

[22] Filed: Jun. 13, 1988

[51] Int. Cl.[4] ..... C21C 5/48

[52] U.S. Cl. ..... 266/265; 266/224

[58] Field of Search ..... 266/218, 220, 265, 266, 266/270, 224

[56] References Cited

U.S. PATENT DOCUMENTS

| | | | |
|---|---|---|---|
| 4,340,208 | 7/1982 | Vayssiere et al. | 266/220 |
| 4,396,179 | 8/1983 | LaBate | 266/220 |
| 4,483,520 | 11/1984 | LaBate | 266/220 |
| 4,538,795 | 9/1985 | LaBate | 266/220 |
| 4,555,266 | 11/1985 | Wells | 266/44 |
| 4,632,367 | 12/1986 | LaBate | 266/220 |
| 4,647,020 | 3/1987 | Liesch et al. | 266/270 |
| 4,709,905 | 12/1987 | Winkelmann et al. | 266/270 |
| 4,725,047 | 2/1988 | LaBate | 266/270 |
| 4,735,400 | 4/1988 | Tate et al. | 266/270 |
| 4,768,267 | 9/1988 | Burbach et al. | 266/220 |

*Primary Examiner*—Robert L. McDowell

*Attorney, Agent, or Firm*—Harpman & Harpman

[57] ABSTRACT

A device for introducing gas into a mass of molten metal in a vessel for creating a stirring action therein by way of an apertured block in the refractory lining of said vessel. The device communicates with an opening in the vessel, the opening being sized to permit the introduction and/or exchange of a device core upwardly into the apertured block from the outside bottom or wall of the vessel. The core has a plurality of passageways therethrough and preferably incorporates a conical sleeve thereabout and an apertured spacer therebelow through which a gas supply extends. A removable closure for the opening in the outside bottom or wall of the vessel normally supports the replaceable stirring device when the vessel is in use.

7 Claims, 2 Drawing Sheets

EXTERNALLY REPLACEABLE STIRRING PLUG FOR MOLTEN METAL VESSELS

BACKGROUND OF THE INVENTION

1. Technical Field:

This invention relates to devices for insufflating gas into a mass of molten metal wherein the insufflating device is positioned in the vessel upwardly from the exterior of the bottom or wall of the vessel rather than being positioned downwardly in the vessel as heretofore customary.

2. Description of the Prior Art

Prior structures have generally employed permeable plugs or solid plugs and spaced jackets thereabout positioned in apertured pocket blocks. Frusto-conical apertures in the pocket blocks received the permeable frusto-conical plugs or solid frusto-conical plug and jacket combinations, all of the prior art devices being so formed that replacement of the pocket block and the permeable or solid plug and jacket assemblies were made from the interior of the vessel necessitating a lengthy and complicated procedure.

Typical prior art devices may be seen in U.S. Pat. Nos. 4,396,179 to LaBate, 4,383,520 to LaBate, 4,538,795 to Labate, 4,632,367 to LaBate, 4,687,184 to LaBate, et al. and 4,725,047 to LaBate.

The present invention comprises an improvement with respect to the devices disclosed in my above-mentioned U.S. Patents. The present invention enables the relatively rapid and easy initial placing of a gas introducing device in a hot metal vessel from the exterior of the vessel by way of an opening in the bottom wall of the vessel which eliminates the heretofore believed necessary tearing out the refractory safety lining and working lining necessary in molten metal vessels such as ladles, furnaces, tundishes or the like. The down time of a ladle, furnace or tundish is thus considerably reduced at a substantial cost savings as eroded gas introducing devices are readily and quickly replaced from the exterior of the vessel.

SUMMARY OF THE INVENTION

A device for introducing gas into molten metal having a refractory lining and an apertured block positioned in the lining in registry with an opening in the bottom wall of the vessel, the aperture in the block being frusto-conical and arranged to receive a refractory sleeve and a core having passageways longitudinally thereof positioned in the sleeve and held in intimate contact with the aperture in the block by a refractory spacer through which a gas introducing passageway extends. A removable portion of the vessel bottom plate permits the initial insertion of the device upwardly into the frusto-conical passageway in the block and when the device is eroded or otherwise affects the flow of gas upwardly therethrough, it is easily and quickly removed downwardly and a replacement assembly moved into the frusto-conical aperture in the block rendering the hot metal vessel usable with the assurance that the stirring gas being introduced into the device reaches the molten metal in desired quantities at desired locations.

DESCRIPTION OF THE PREFERRED EMBODIMENT

Figure 1:
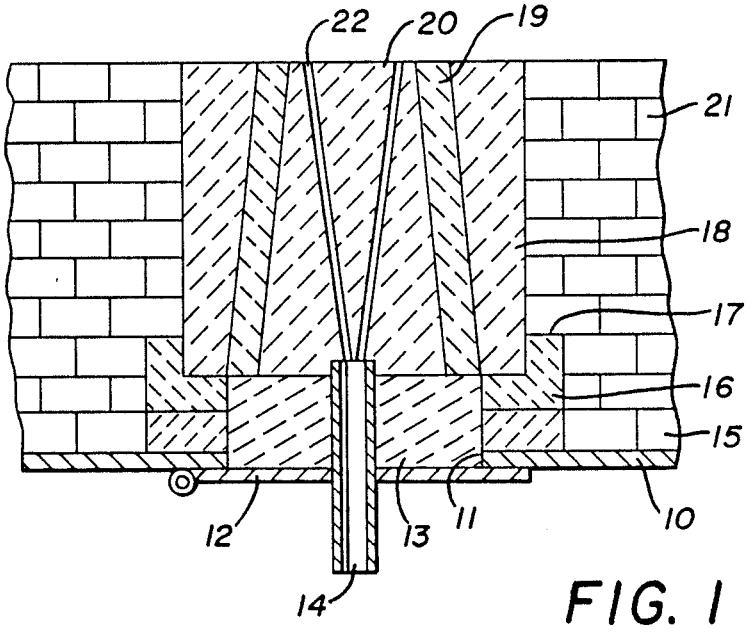
FIG. 1 is a vertical section through a portion of a vessel showing the device for introducing gas into molten metal installed therein.
Figure 3:
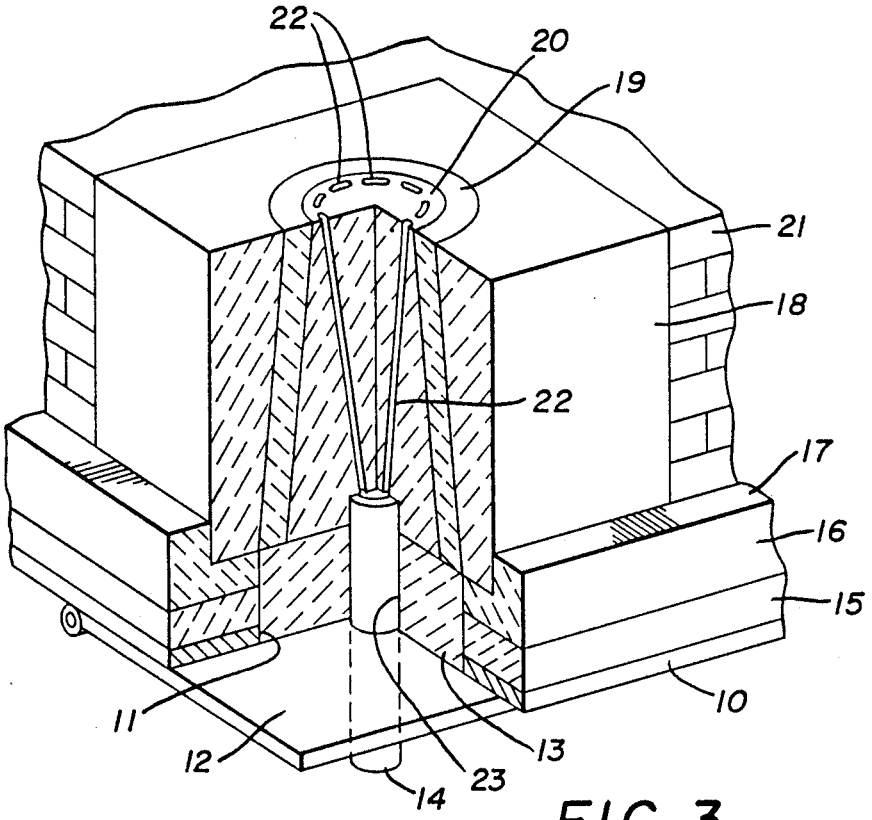
FIG. 3 is a perspective view of a portion of a vessel, the refractory lining and apertured block therein with parts broken away and parts in cross section illustrating the device of the invention in operative position.

In the form of the invention chosen for illustration herein the device for introducing gas into molten metal in an improved manner and wherein the device is readily replaceable by moving the same through an opening in a bottom wall of the vessel may be seen in FIGS. 1 and 3 of the drawings.

By referring to FIG. 1, the bottom wall 10 of a vessel, such as a ladle, furnace, tundish or the like for containing molten metal, will be seen to be provided with an opening 11 which is normally closed by a movable support plate 12. The opening 11 is of a size to receive a refractory spacer 13 which is supported by the support plate 12, the spacer 13 having a central aperture through which a gas supply pipe 14 extends. The usual safety lining 15 of a molten metal vessel is apertured to receive the refractory spacer 13 and a safety plate 16 such as disclosed in my above-mentioned U.S. Pat. No. 4,725,047 is positioned on the safety lining 15 and apertured to receive the upper portion of the refractory spacer 13 which is preferably cross sectionally circular. The safety plate 15 has an annular upturned flange 17 around a flat central area which registers with the upper surface of the refractory spacer 13 and supports a centrally apertured block 18, the aperture being frusto-conical in shape and cross sectionally circular. A frusto-conical refractory sleeve 19 also cross sectionally circular is positioned in and registers with the central aperture in the block 18 and a frusto-conical refractory plug 20 also cross sectionally circular is positioned in and registers with the frusto-conical refractory sleeve 19, the arrangement being such that molten metal is unable to flow downwardly between the registering surfaces of the block 18, sleeve 19 and plug 20 of the gas introducing device.

The usual refractory lining 21 is positioned on the safety lining 15 of the vessel and extends upwardly to a level flush with the upper surface of the centrally apertured block 18, the frusto-conical refractory sleeve 19 and the frusto-conical refractory plug 20.

Still referring to FIG. 1, it will be seen that a plurality of relatively small passageways 22 are formed in the refractory plug 20 and are so positioned as to be able to communicate with the upper end of the gas supply pipe 14 which is engaged in the lower end of the frusto-conical plug 20.

By referring to FIG. 3 of the drawings, it will be seen that the upper ends of the small passageways 22 are arranged in a circular pattern spaced radially from the axis of the cross sectionally circular plug 20 and that each of the passageways 21 is of a flattened oval shape such that a desirable volume of gas at a desirable pressure can be introduced upwardly therethrough and into the molten metal in the vessel in which the device is installed.

It will occur to those skilled in the art that by forming other frusto-conical refractory plugs 20 with different sized small passageways 22 therein, a desired volume of gas may be introduced into the molten metal from a gas source supplying gas at a fixed pressure, for example 200 lbs. per square inch, and whereby the desired discharge rate, for example 100 ft. per minute, may be obtained and that when the gas pressure supply is higher than that of the foregoing example the shaping of the small passageways 21 to form narrower elongated jet-like openings will still maintain the desired rate of gas introduction into the molten metal due to the control provided by the shaped passageways 22. A suitable passageway 22 may be for example 0.026 100ths of an inch in length by 0.26 100ths of an inch in width. It will be understood that the pressure of gas supplied in a stirring operation and the volume are determined by the area and depth of the mass of molten metal in the vessel so that an adequate stirring of the molten metal may be achieved.

Figure 2:
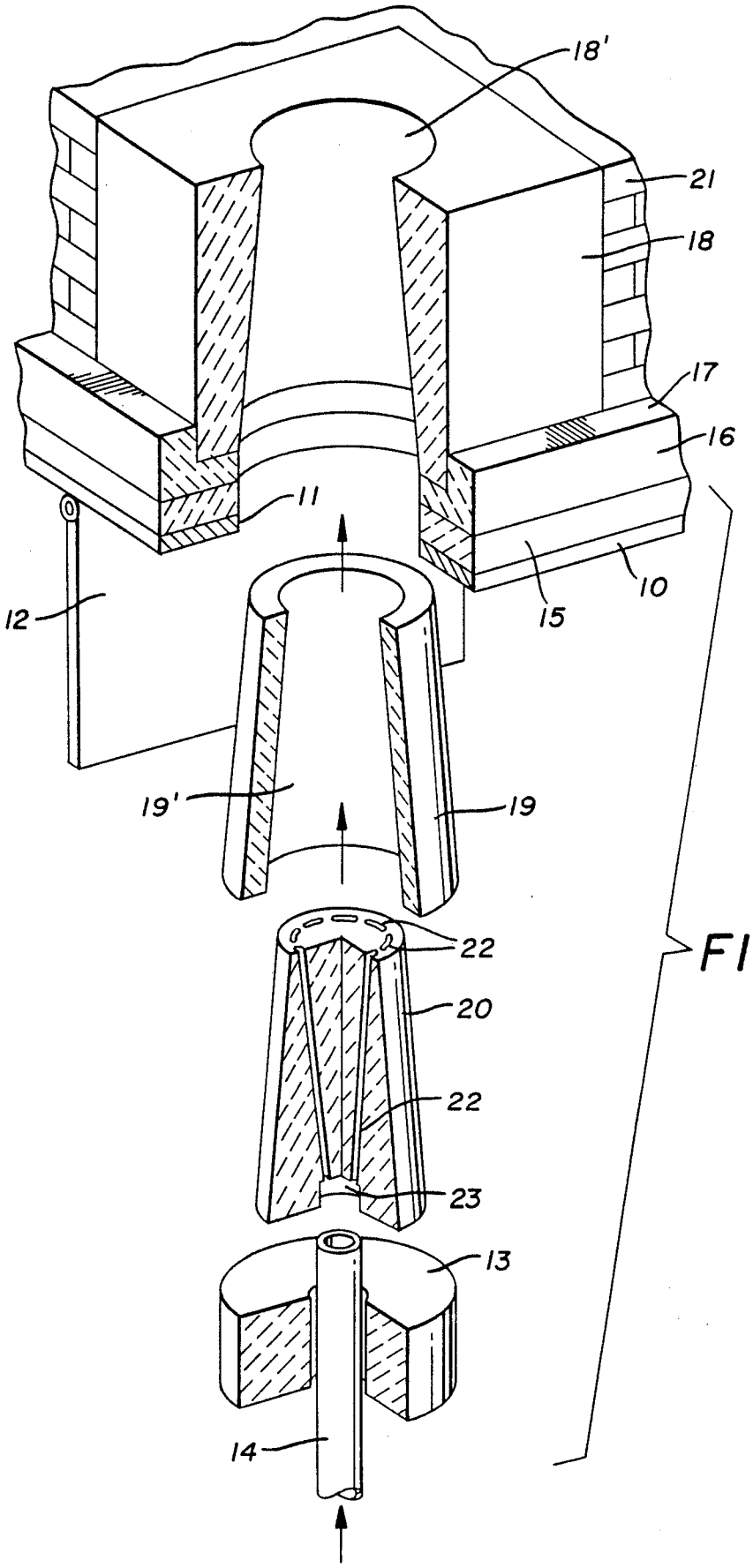
FIG. 2 is an exploded view showing a portion of a hot metal vessel having a refractory lining and an apertured block therein with parts broken away and parts in cross section and illustrating an externally insertable gas introducing device.

By referring now to FIG. 2 of the drawings, an exploded perspective view of the device of the invention as installed in a vessel with parts in cross section may be seen. The bottom wall 10 of the vessel, the safety lining 15 thereof, the safety plate 16 and the apertured block 18 being shown assembled and in registry with the opening 11 in the bottom wall 10 of the vessel. The movable support plate 12 is shown moved to open position so that the frusto-conical refractory sleeve 19 may be moved upwardly through the opening 11 and into registry with the frusto-conical aperture 18' in the apertured block 18. The exterior surface of the frusto-conical refractory sleeve 19 is sized to sealingly engage the frusto-conical aperture 18' in the block 18. The interior 19' of the frusto-conical refractory sleeve 19 is sized to sealingly register with the exterior of the frusto-conical refractory plug 20 and a cavity 23 is formed inwardly of the bottom of the plug 20 so that the plurality of small passageways 22 communicate therewith. The cavity 23 is sized to fit over the upper end of the gas supply pipe 14 which extends upwardly through the centrally apertured refractory spacer 13 as hereinbefore described.

It will thus be seen that an externally replaceable stirring plug for molten metal vessels has been disclosed and that the arrangement and formation of the several parts, specifically the frusto-conical refractory sleeve 19 and the frusto-conical refractory plug 20 which are subject to erosion in the hot metal bath in the vessel may be quickly and easily replaced by moving the gas supply pipe 14 and support plate 12 to free the refractory spacer 13 and permit the refractory core 20 and refractory core sleeve to be removed downwardly and out of the aperture 18' in the apertured block 18 whereupon a replacement sleeve and plug may be moved upwardly into registry with the aperture 18' by the spacer 13 and the movable support plate 12 repositioned in normally closed relation with respect to the opening 11 and the gas pipe 14 repositioned, the several operations being completely conducted from the exterior of the vessel.

It will occur to those skilled in the art that if desired small amounts of refractory cement may be used to insure the sealing of the several parts to prevent the flow of molten metal therebetween, particularly when erosion has taken place in the upper portions of the apertures block 18.

It will be recognized that the principal advantage of the disclosed invention lies in the interchangeability of the respective parts resulting in a simple, efficient, readily installed and removed device for introducing gas into molten metal for stirring purposes and the like and having thus described my invention, what I claim is:

1. In a device for introducing gas into a mass of molten metal in a vessel having a refractory lining and an apertured block of a known height having horizontally disposed upper and lower surfaces and vertically disposed side surfaces positioned in said lining with said aperture in registry with an opening in said vessel, the improvement comprising a refractory core of the same height as said apertured block registable with said aperture in said block, passageways formed in and extending through said refractory core, said refractory core and said opening in said vessel being of substantially the same size so that said refractory core may be moved through said opening in said vessel into said aperture in said block, means for delivering gas to said passageways in said core and means for supporting said core in said block , said means for supporting said core in said block consisting of a spacer and a support plate therefor, said support plate being removably attached to said vessel.

2. The improvement in a device for introducing gas into a mass of molten metal set forth in claim 1 wherein said aperture in said block and said core have upper and lower ends with said lower ends being substantially larger than said upper ends.

3. The improvement in a device for introducing gas into a mass of molten metal set forth in claim 1 and wherein said aperture in said block and said core are frusto-conical and sized to register with one another when said core is moved into said aperture.

4. The improvement in a device for introducing gas into a mass of molten metal set forth in claim 1 wherein said core consists of a plug, said passageways being in said plug and a sleeve in which said plug registers, said sleeve registrable with said aperture in said block and being of the same height as said core.

5. The improvement in a device for introducing gas into a mass of molten metal set forth in claim 5 wherein said plug and said sleeve are frusto-conical and said aperture in said block is frusto-conical.

6. The improvement in a device for introducing gas into a mass of molten metal as set forth in claim 1 and wherein said core consists of a refractory plug, said passageways being in said plug and a refractory sleeve in which said plug registers and wherein said block is refractory and an apertured safety plate is positioned in said lining beneath said refractory plug and refractory sleeve and wherein an apertured spacer supports said core and is positioned in said aperture in said safety plate and the aperture in said lining.

7. The improvement in a device for introducing gas into a mass of molten metal set forth in claim 1 wherein said core consists of a plug, said passageways being in said plug, a sleeve in which said plug registers and a spacer, said plug and sleeve being frusto-conical and said spacer being circular and apertured.

* * * * *